United States Patent [19]

Hildebrandt

[11] Patent Number: 4,962,788

[45] Date of Patent: Oct. 16, 1990

[54] ARRANGEMENT FOR TREATING HAIR WITH LIQUID IN CIRCULATING PROCESS

[75] Inventor: Bodo Hildebrandt, Riedstadt, Fed. Rep. of Germany

[73] Assignee: Wella Aktiengesellschaft, Darmstadt, Fed. Rep. of Germany

[21] Appl. No.: 167,831

[22] Filed: Mar. 14, 1988

[30] Foreign Application Priority Data

Mar. 12, 1987 [DE] Fed. Rep. of Germany ..... 3708009

[51] Int. Cl.[5] ..... F16K 57/00

[52] U.S. Cl. ..... 137/557; 137/565; 137/93; 134/57 R; 134/113; 417/12

[58] Field of Search ..... 137/93, 563, 565, 557; 417/12, 96, 44; 239/120, 121, 63, 64; 134/113, 57 R

[56] References Cited

U.S. PATENT DOCUMENTS

| | | | |
|---|---|---|---|
| 2,204,225 | 6/1940 | Merckel | 137/2 |
| 3,319,637 | 5/1967 | Gore et al. | 134/113 |
| 3,554,212 | 1/1971 | Maroney | 137/93 |
| 3,768,499 | 10/1973 | Dziomba et al. | 137/93 |
| 4,033,871 | 7/1977 | Wall | 137/93 |
| 4,066,092 | 1/1978 | Dulcer et al. | 137/93 |
| 4,190,481 | 2/1980 | Goffredo | 134/57 R |
| 4,211,517 | 7/1980 | Schmid | 417/12 |
| 4,273,146 | 6/1981 | Johnson | 137/2 |
| 4,306,581 | 12/1981 | Alandt | 137/93 |

FOREIGN PATENT DOCUMENTS 8532878 2/1986 Fed. Rep. of Germany .

*Primary Examiner*—A. Michael Chambers
*Attorney, Agent, or Firm*—Michael J. Striker

[57] ABSTRACT

An arrangement for treating hair with a liquid in a circulating process, comprises a circulating pump, an electric motor arranged to drive the circulating pump, a treatment time determining device, at least one treatment start switch arranged to control the treatment time determining device, the treatment time determing device being connected with the electric motor so that the electric motor is turned off at a treatment end, and a sensing element arranged to sense a parameter of a treatment liquid and operative so that the treatment time determining device is controlled through the sensing element in dependence upon the parameter of the treatment liquid which no longer substantially changes.

14 Claims, 3 Drawing Sheets

ARRANGEMENT FOR TREATING HAIR WITH LIQUID IN CIRCULATING PROCESS

BACKGROUND OF THE INVENTION

The present invention relates to an arrangement for treating hair with a liquid in a circulating process.

Arrangements of the above mentioned general type are known in the art. One of such arrangements is disclosed in the German Gebrauchsmuster No. G 85 32 878. For operation of this arrangement, a manual switch is provided, which can switch on and off the electric motor for the circulating pump. An optimal treatment result is produced only when the required treatment time is not exceeded, for example during the fixing treatment of permanent-wave-liquid treatment hair. This is insured only when the user of such an arrangement uses a special stop watch and watches it to switch off the arrangement manually. It is believed to be clear that the arrangement which must be operated in this manner prosesses certain disadvantages.

SUMMARY OF THE INVENTION

Accordingly, it is an object of the present invention to provide an arrangement of this type for treating hair, which avoids the disadvantages of the prior art.

More particularly, it is an object of the present invention to provide an arrangement of this type for treating hair, in which the required treatment is controlled automatically.

In keeping with these objects and with others which will become apparent hereinafter, one feature of the present invention resides, briefly states in an arrangement for treating hair with a liquid in a circulating process, comprising a circulating pump, an electric motor arranged to drive the circulating pump, a treatment time determining device, at least one treatment start switch arranged to control the treatment time determining device, the treatment time determining device being connected with the electric motor so that the electric motor is turned off at a treatment end, and sensing means arranged to sense a parameter of a treatment liquid and operative so that the treatment time determining device is controlled through the sensing means in dependence upon the parameter, of the treatment liquid which no longer substantially changes. Advantageously, the treatment end signal generator is arranged in or on the circulating pump unit.

The present invention utilizes the changing electrical conductivity or the pH value of the fixing treatment liquid. The logic behind this is that the fixing treatment is considered to be finished when the electrical conductivity or the pH value of the fixing liquid no longer substantially changes. For this purpose an electrical conductivity sensor or a test value receiver (pick up) are provided, which control the treatment time determining device in dependence upon no longer substantially changing electrical conductivity or pH value of the treatment liquid. It is also possible to provide additional substances (salts) which have outstanding electrical conductivity or pH value, for optimizing the inventive measuring process.

Advantageously, the conductivity sensor or the pH test value receiver is integrated in the circulating pump unit in a circulating circuit.

With the use of the conductivity sensor or the pH test value receiver such a measuring process is recommended in accordance with which for determination of the treatment end a measuring device is provided which after the start of treatment forms measuring values in identical intervals, continuously compares two measuring values which lie near one another, and upon reaching a predetermined difference value, controls the device for switching off.

For achieving a high measurement accuracy, it is proposed that the measuring device forms an average value in identical measuring intervals and compares it with the subsequent average value, and then the device is controlled at a predetermined average value. This measuring process has the advantage that an error value does not lead the arrangement to the operation end, but instead because of the formed average value the error value does not become effective. For a higher measuring safety it can be provided that a predetermined difference value of average values must be again confirmed, for then ending the treatment process.

The novel features which are considered as characteristic of the invention are set forth in particular in the appended claims. The arrangement itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
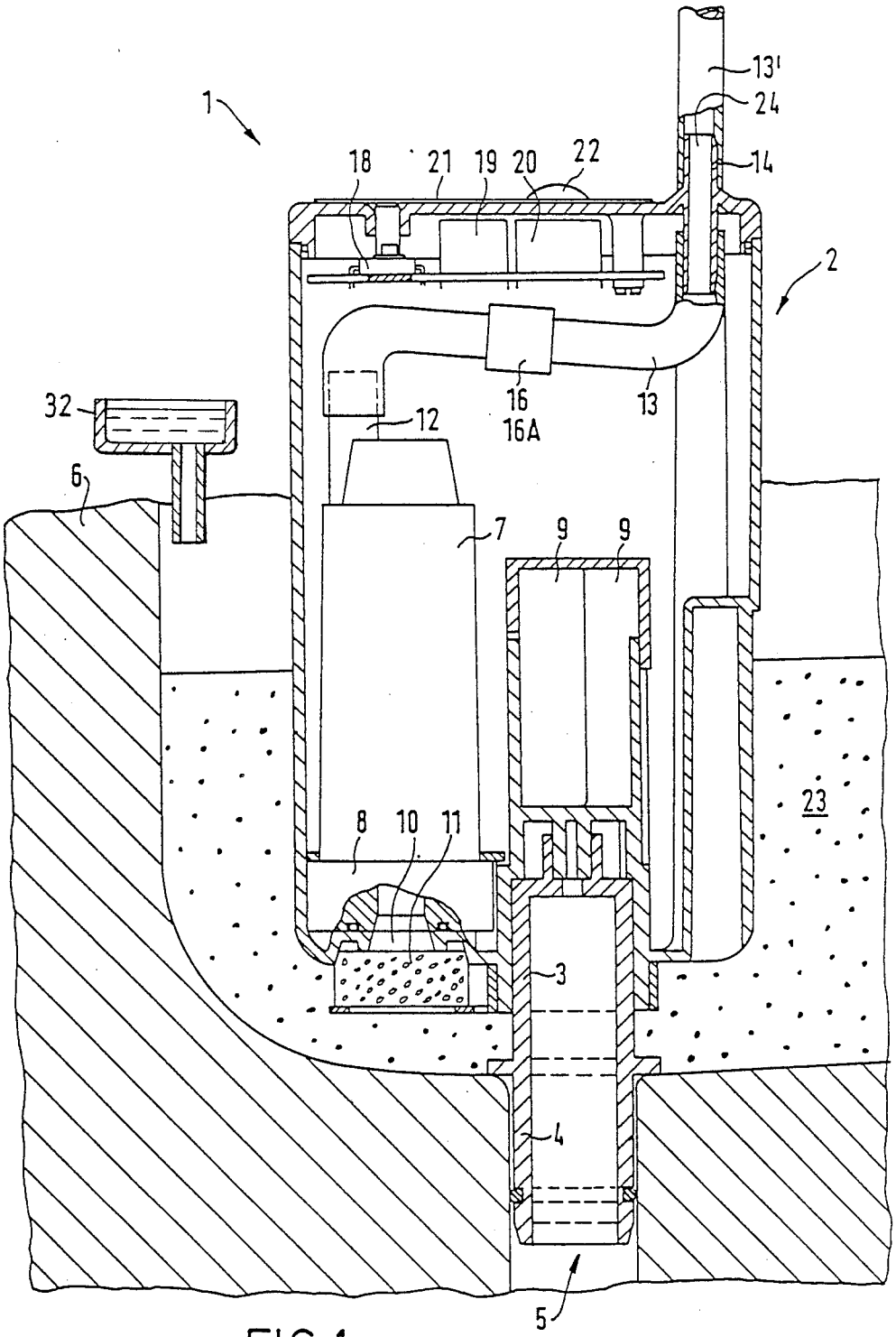
FIG. 1 is a view showing a section of an arrangement in accordance with this present invention, with a circulating pump unit located in a flushing basin.

FIG. 1 shows an arrangement for treating hair, which is identified as a whole with reference numeral 1. It has a circulating pump 2 which is connected through a foot 3 with a plug 4 with a discharge opening 5 of a flushing basin 6. The circulating pump 2 has a pump 8 which is driven by an electric motor 7. The electric motor is supplied with power from accumulators 9. An aspirating opening 10 is located under the pump 8 and provided with a filter 11.

An outlet passage 12 of the pump 8 is connected with a hose 13 which in turn is connected with a hose joint 14. An electrical conductivity sensor 16 or a pH test value receiver **16*a* are arranged in the hose 13. In the upper region of the circulating pump unit 2 inside it there are located a treatment start switch 18, a measuring and control device 19, and a treatment time determining device 20. An acoustic and/or optical indicator 22 is arranged in a control field 21 of the circulating pump unit 2. The circulating pump unit 2 communicates with the fluid 23 which serves for treatment of hair in a circulating process, through the aspirating opening 10 of the pump 8. An outlet opening 24 communicates with a hose 13'** which is connected at its other end with a not shown spraying head.

Figure 2:
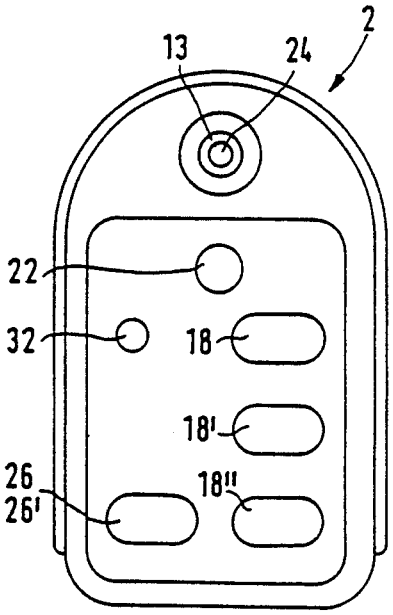
FIG. 2 is a plan view of the circulating pump unit with operational elements and indicators.

A plan view of the circulating pump unit 2 with a control field 21 is shown in FIG. 2. The control field 21 is provided with several treatment start switches 18, 18', 18'' and has a cutout switch 26 or a stop switch 26'. In addition to the treatment end indicator 22, a charging condition indicator 32 for the accumulators 9 is provided. By means of the switch 18, 18', 18'' and via the treatment time determining device 20, the arrangement 1 is turned into operation by switching on of the electric motor 7. After elapsing of the predetermined treatment time, the arrangement turns off the motor 7. During the treatment, the arrangement 1 can be turned off also by the stop switch 26' in the event of any danger.

Figure 3:
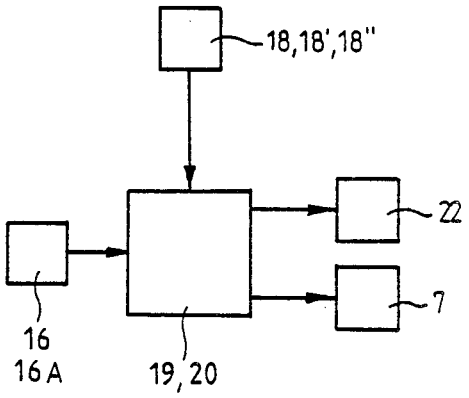
FIG. 3 is a block-diagram for automatic control of the inventive arrangement.

FIG. 3 shows a block diagram for an automatically running treatment time by means of different sensors **16, 16*a*. For this purpose the measuring and control device 19 is provided, which is connected with a conductivity sensor 16 or a pH test value receiver 16, through its input. At the output side, the measuring and control device 19 is connected with the treatment time determining device 20 which controls the electric motor 7 for the pump 8. After actuation of the treatment start switches 18, 18', 18'', the measuring and control device 19 is activated and turns on the electric motor 7. The conductivity sensor 16 senses for detecting a conductivity condition of the circulating liquid 23. The fixing treatment can be considered as finished when the measured conductivity or pH value no longer substantially changes, and then the electric motor 7 can be turned off by the device 20**. Further treatment start switches can be provided for different hair qualities or quantities, for achieving a respectively automatically adjusted treatment time.

Figure 4:
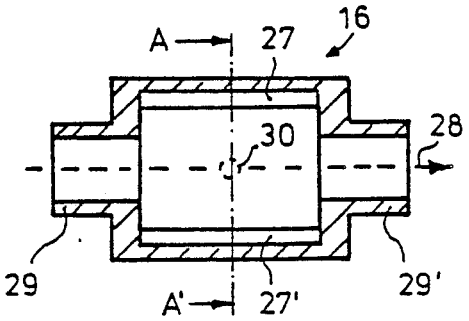
FIG. 4 is a view showing an axial section of a conductivity sensor of the inventive arrangement.

FIG. 4 shows an axial cross-section of the conductivity sensor 16. It is provided with two opposite electrodes 27 and 27'. The arrow 28 shows the direction of flow of the liquid 23. The conductivity sensor 16 has hose joints 29 and 29' at its both sides, so that it can h=introduced into the hose 13.

Figure 5:
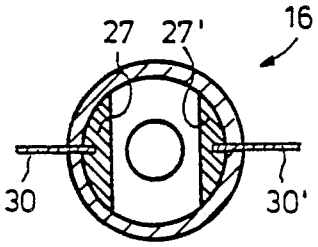
FIG. 5 is a view showing a section A–A′ of the conductivity sensor of FIG. 4.

FIG. 5 shows a section A-A' of the conductivity sensor of FIG. 4. The electrodes 27, 27' are provided with electrical terminals 30 and 30' and lead to the measuring and control device 19.

Figure 6:
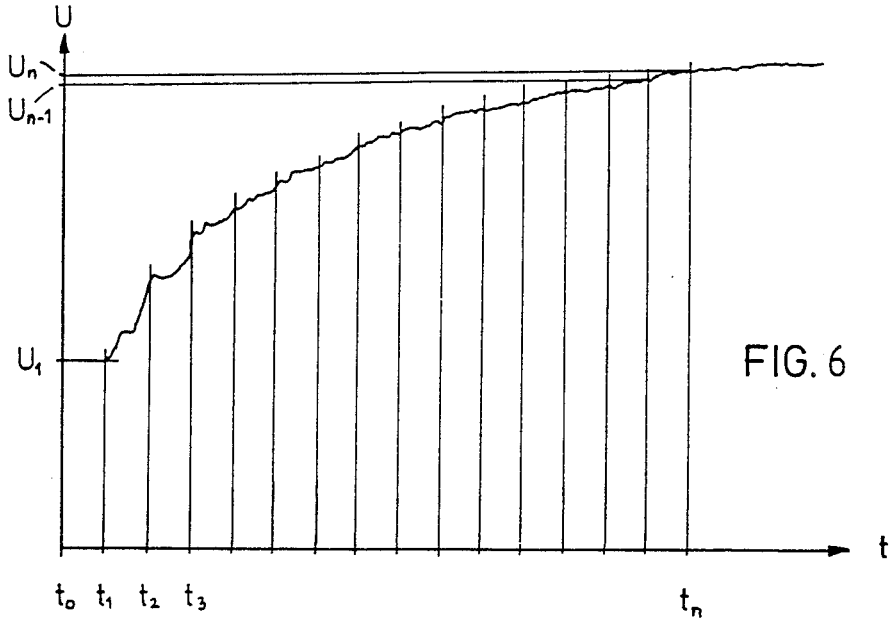
FIG. 6 is a measuring diagram for an automatic program operations of the arrangement.

A measuring diagram for determining the automatic treatment end is shown in FIG. 6. The conductivity values or pH values are converted into proportional voltage values. After actuation of the treatment start switch 18 at the time point $t_0$ the treatment process starts. Within identical time intervals, at the time point $t_1$ a voltage $U_1$, at the time point $t_2$ a voltage $U_2$, etc. are measured. At achieving a predetermined voltage difference value $U_{n-1}$-$U_n$ during a fixing process, the treatment is ended at the time point $t_n$. For the purpose of a higher measuring safety, it can be provided that a predetermined difference value must be again confirmed, here at the time point $t_{n+1}$.

Figure 7:
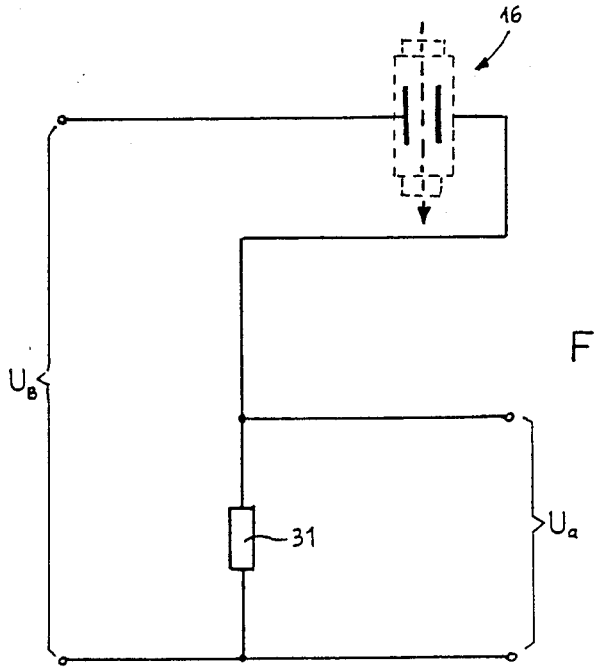
FIG. 7 is a measuring circuit diagram for determining voltage values in dependence upon liquid conductivity values.

FIG. 7 shows a respective measuring circuit for conversion of conductivity values into voltage values. The conductivity sensor 16 and a resistor 31 are supplied with a supply voltage $U_B$ in series. The voltage $U_a$ measured at the resistor 31 is supplied to the measuring and control device 19 for further processing.

The arrangement is also provided with a source of a substance, for example salt, which can be added to the treatment liquid for optimizing the measuring accuracy. Such a substance increases the electrical conductivity or pH characteristic of the treatment liquid. The source of substance is identified with reference numeral 32.

It will be understood that each of the elements described above, or two or more together, may also find a useful application in other types of constructions differing from the types described above.

While the invention has been illustrated and described as embodied in an arrangement for treating hair with liquid in circulating process, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. An arrangement for treating hair with a treatment liquid in a circulating process, comprising a circulating pump for circulating said treatment liquid;

an electric motor arranged to drive said circulating pump;

means for starting said electric motor connected to said electric motor including at least one treatment start switch;

means for determining a treatment end including sensing means arranged to sense a parameter of said treatment liquid, said means for determining said treatment end being structured to determine when said parameter of said treatment liquid becomes a constant, said treatment end occurring when said parameter becomes constant;

means for shutting off said motor connected with said means for determining said treatment end, said means for determining said treatment end and said means for shutting off said motor being structured so that said electric motor is turned off at said treatment end when said parameter is determined to be constant; and means for optimizing a measuring accuracy of said parameter.

2. An arrangement as defined in claim 1, wherein said parameter of said treatment liquid is an electrical conductivity of said treatment liquid and said means for optimizing said measuring accuracy includes a supply source for supplying a substance increasing said electrical conductivity to said treatment liquid.

3. An arrangement as defined in claim 2, wherein said supply source is a salt supplying source.

4. An arrangement as defined in claim 1, wherein said means for determining a treatment end includes a measuring and control device structured to form an average value of a predetermined number of measured values of said parameter of said treatment liquid in each of a plurality of identical measuring intervals, forming at least one difference value between successive ones of said average values and controlling said means for determining said treatment end according to said difference value.

5. An arrangement as defined in claim 4, wherein said parameter is determined to be constant when said difference value falls below a certain predetermined value.

6. An arrangement as defined in claim 1, wherein said parameter is a pH of said treatment liquid, said sensing means comprises a pH test value receiver and said means for optimizing said measuring accuracy includes a supply source for supplying a substance increasing a pH characteristic of said treatment liquid.

7. An arrangement as defined in claim 1; and further comprising a circulating unit which includes said circulating pump and forms a circulating circuit, said sensing means being arranged in said circulating circuit of said circulating pump unit.

8. An arrangement as defined in claim 1; wherein said means for determining said treatment end includes a measuring and control device structured for forming after a treatment start a plurality of measured values of said parameter in identical intervals, continuously comparing successive ones of said measured values and controlling said means for determining said treatment time when a predetermined difference of said measured values is reached.

9. An arrangement as defined in claim 1, and further comprising a circulating pump unit which includes said circulating pump, said means for determining said treatment end being arranged in said circulating pump unit.

10. An arrangement as defined in claim 1, and further comprising a circulating pump unit which includes said circulating pump, said means for determining said treatment end being arranged on said circulating pump unit.

11. An arrangement as defined in claim 1, wherein said means for determining said treatment end includes indicating means.

12. An arrangement as defined in claim 11, wherein said indicating means includes an acoustic indicator.

13. An arrangement as defined in claim 11, wherein said indicating means includes an optical indicator.

14. An arrangement as defined in claim 11, wherein said indicating means includes an acoustic and optical indicator.

* * * * *